US011833411B2

(12) United States Patent
Piumarta

(10) Patent No.: US 11,833,411 B2
(45) Date of Patent: Dec. 5, 2023

(54) SKATEBOARD TRUCK WITH INVERTED KING PIN AND INTEGRATED KINGPIN FASTENER

(71) Applicant: NHS, Inc., Santa Cruz, CA (US)

(72) Inventor: Timothy Charles Piumarta, Aptos, CA (US)

(73) Assignee: NHS, Inc., Santa Cruz, CA (US)

( * ) Notice: Subject to any disclaimer, the term of this patent is extended or adjusted under 35 U.S.C. 154(b) by 0 days.

(21) Appl. No.: 17/958,765

(22) Filed: Oct. 3, 2022

(65) Prior Publication Data

US 2023/0027262 A1 Jan. 26, 2023

Related U.S. Application Data

(63) Continuation of application No. 17/158,393, filed on Jan. 26, 2021, now Pat. No. 11,491,389.

(60) Provisional application No. 63/105,530, filed on Oct. 26, 2020.

(51) Int. Cl.
*A63C 17/01* (2006.01)

(52) U.S. Cl.
CPC ..... *A63C 17/012* (2013.01)

(58) Field of Classification Search
CPC ..... A63C 17/012
See application file for complete search history.

(56) References Cited

U.S. PATENT DOCUMENTS 1,640,134 A 8/1927 Salberg
4,311,319 A 1/1982 Snyder et al.
4,398,734 A 8/1983 Barnard
4,443,022 A 4/1984 Ware
4,898,398 A 2/1990 Cassel
5,397,141 A 3/1995 Hoshizaki et al.
5,879,013 A 3/1999 Shih
6,070,886 A 6/2000 Cornelius et al.
6,182,987 B1 * 2/2001 Bryant ..... A63C 17/012 280/11.28
6,467,782 B1 10/2002 Smith
6,474,666 B1 * 11/2002 Andersen ..... A63C 17/0093 280/87.041
6,793,224 B2 9/2004 Stratton
(Continued)

OTHER PUBLICATIONS

Grindking.com, "About", 2021, grindking.com/about-grindking/, retrieved on Jul. 26, 2021, 3 pages.
Youtube.com, "Grind King Disruptor Review!!! ", uploaded Sep. 28, 2019, https://www.youtube.com/watch?v=77wjdaOYpOk, 4 pages.
(Continued)

*Primary Examiner* — Bryan A Evans
(74) *Attorney, Agent, or Firm* — Dority & Manning, P.A.

(57) ABSTRACT

A skateboard truck includes a metal bolt called a kingpin and a threaded fastener, called a hex nut, which when combined hold the two main components of a truck together: the baseplate, which is mounted to the bottom surface of the skateboard deck; and the turning part of the truck called the hanger, which is mounted onto the baseplate by means of the kingpin, and affixed tightly into the baseplate by means of a threaded hex nut. Two bushings placed along the shaft of the kingpin and on either side of a flange protruding from the hanger hold the hanger in place by the tightening of the kingpin into the threaded shaft nut fastener. The kingpin is oriented such that a threaded portion of the kingpin (on an end opposite a bolt head portion) is generally facing towards a bottom surface of the skateboard deck.

20 Claims, 11 Drawing Sheets

(56) References Cited

U.S. PATENT DOCUMENTS

| | | | | |
|---|---|---|---|---|
| 6,932,362 | B1 | 8/2005 | Barrett | |
| 7,104,558 | B1 * | 9/2006 | Saldana | A63C 17/0093 280/11.27 |
| 7,722,060 | B1 | 5/2010 | Clark | |
| 11,224,793 | B1 | 1/2022 | Piumarta | |
| 2004/0145142 | A1 | 7/2004 | Wang | |
| 2004/0207169 | A1 | 10/2004 | Kent et al. | |
| 2004/0245738 | A1 | 12/2004 | Inchley | |
| 2006/0097470 | A1 | 5/2006 | Chmelar | |
| 2009/0079147 | A1 | 3/2009 | Conners et al. | |
| 2011/0236607 | A1 | 9/2011 | Woncik | |
| 2013/0113170 | A1 | 5/2013 | Braden et al. | |
| 2013/0308887 | A1 | 11/2013 | Gesmer | |
| 2017/0087441 | A1 | 3/2017 | Ivazes | |
| 2017/0203193 | A1 | 7/2017 | Powell et al. | |
| 2018/0193721 | A1 * | 7/2018 | Martinez Almansa | A63C 17/015 |
| 2021/0052970 | A1 | 2/2021 | Tyler | |

OTHER PUBLICATIONS

Youtube.com, "Grind King Disruptor—First Look!", uploaded Apr. 5, 2019, https://www.youtube.com/watch?v=HsNfydyN3ew, 3 pages.
Youtube.com, "Grind King Disruptor Update", uploaded Oct. 5, 2019, https://www.youtube.com/watch?v=YD9PL9hWPzM, uploaded on Oct. 5, 2019, 2 pages.
Non-Final Office Action issued by the U.S. Patent and Trademark Office for U.S. Appl. No. 17/667,922, dated Jul. 21, 2022, 12 pages.
European Search Report for Application No. EP 21204570.2, dated Mar. 23, 2022, 7 pages.
1990 Advertisement for Gordon & Smith Trucks, 1 page.

* cited by examiner

SKATEBOARD TRUCK WITH INVERTED KING PIN AND INTEGRATED KINGPIN FASTENER

CROSS REFERENCE TO RELATED APPLICATIONS

The present application is a continuation of U.S. patent application Ser. No. 17/158,393 having a filing date of Jan. 26, 2021 and claims filing benefit of U.S. Provisional Patent Application Ser. No. 63/105,530 having a filing date of Oct. 26, 2020, both of which are incorporated herein by reference in their entirety.

FIELD

The present disclosure generally relates to skateboard trucks, and, more particularly, truck kingpins and fasteners of that affix a turning axle to a mounting baseplate.

BACKGROUND

Skateboards have been a popular sporting good in which a user balances on a pivotable deck supported by wheels. One conventional design of a skateboard includes multiple components, including a skateboard deck, one or more skateboard trucks, one or more axels and/or wheels, and/or bearings. The skateboard deck is the platform upon which the user stands. The skateboard trucks are turning devices for the skateboard and additionally the carriers of the axles upon which wheels and bearings are placed. Each truck includes two wheels and four bearings mounted to the axle portion of the truck. The two turning trucks are mounted to the bottom surface of the skateboard deck. Finally, it is common to have mounted on the top surface of the skateboard an anti-skid or anti-slip tape, providing traction for the user as to not slip off the deck when riding the skateboard.

SUMMARY

Aspects and advantages of embodiments of the present disclosure will be set forth in part in the following description, or may be learned from the description, or may be learned through practice of the embodiments.

One example aspect of the present disclosure is directed to a skateboard truck that includes a baseplate, a hanger, a monocoque hex nut, and a kingpin bolt. The baseplate is configured for mounting to a bottom surface of a skateboard deck. The hanger is configured to hold an axle. The monocoque hex nut is mounted inside the baseplate. The kingpin bolt has a threaded portion affixed to the monocoque hex nut to secure the baseplate and hanger together relative to the bottom surface of the skateboard deck.

In some example aspects of the present disclosure, the kingpin bolt is configured to be tightened into the baseplate.

In some example aspects of the present disclosure, a first end of the kingpin bolt comprises the threaded portion, and a second end of the kingpin bolt comprises a bolt head configured in one of a hex shape or a round shape.

In some example aspects of the present disclosure, the kingpin bolt is oriented such that the first end of the kingpin bolt generally faces the bottom surface of the skateboard deck.

In some example aspects of the present disclosure, the monocoque hex nut comprises a hex portion and a shaft portion adjacent to the hex portion.

In some example aspects of the present disclosure, the hex portion and the shaft portion are formed to define a center hole throughout.

In some example aspects of the present disclosure, an inside surface of the center hole formed throughout the hex portion and the shaft portion comprises cut threads.

In some example aspects of the present disclosure, the monocoque hex nut has a smooth circular outer diameter surface with no threads.

In some example aspects of the present disclosure, the baseplate comprises aluminum.

In some example aspects of the present disclosure, the baseplate is formed in the shape of one of a rectangle, oval, or square.

In some example aspects of the present disclosure, the baseplate comprises first and second opposing primary surfaces.

In some example aspects of the present disclosure, the first primary surface is configured to be positioned coincident with the bottom surface of the skateboard deck.

In some example aspects of the present disclosure, the first primary surface of the baseplate comprises a recessed cavity to fit the monocoque hex nut.

In some example aspects of the present disclosure, the baseplate comprises a through hole that is bored through the recess cavity and out to the second primary surface.

In some example aspects of the present disclosure, the baseplate through hole has the same inside dimension as an outer major surface of the monocoque hex nut.

In some example aspects of the present disclosure, the hanger comprises an aluminum hanger configured to hold a steel axle.

In some example aspects of the present disclosure, the hanger comprises a mounting flange with a through hole at the center of the flange.

In some example aspects of the present disclosure, a major axis of the axle is coincident to a major axis of the hanger.

In some example aspects of the present disclosure, the axle comprises two axle ends with threads cut into each axle end.

In some example aspects of the present disclosure, each axle end is configured to extend beyond surfaces of the hanger.

In some example aspects of the present disclosure, each axle end is configured for bearings and wheels to be affixed thereto.

Another example aspect of the present disclosure is directed to a skateboard including a skateboard truck in accordance with one or more of the exemplary embodiments described herein.

Other aspects of the present disclosure are directed to various systems, apparatuses, non-transitory computer-readable media, user interfaces, and electronic devices.

These and other features, aspects, and advantages of various embodiments of the present disclosure will become better understood with reference to the following description and appended claims. The accompanying drawings, which are incorporated in and constitute a part of this specification, illustrate example embodiments of the present disclosure and, together with the description, serve to explain the related principles.

BRIEF DESCRIPTION OF THE DRAWINGS

Detailed discussion of implementations directed to one of ordinary skill in the art is set forth in the specification, which refers to the appended figures, in which.

Figure 1A:
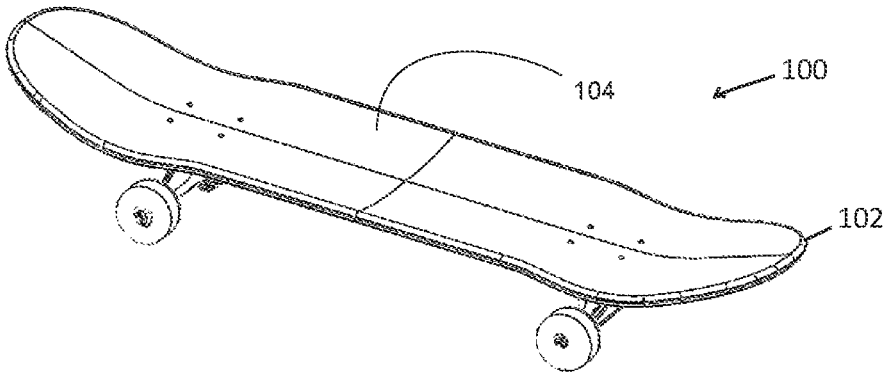
FIG. 1A provides a top perspective view of a skateboard according to example embodiments of the present disclosure.
Figure 1B:
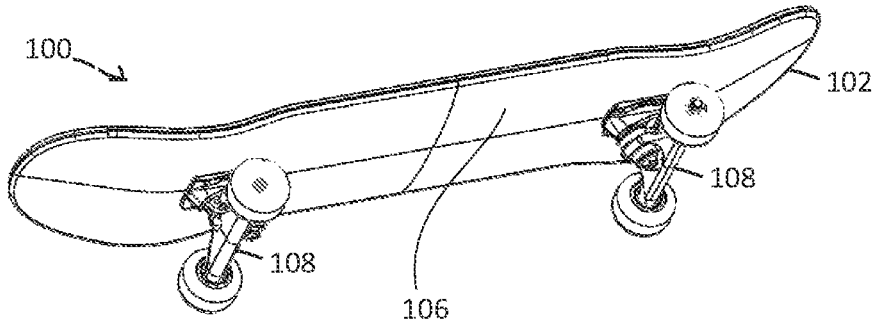
FIG. 1B provides a bottom perspective view of a skateboard according to example embodiments of the present disclosure.

Reference numerals that are repeated across plural figures are intended to identify the same features in various implementations.

DETAILED DESCRIPTION

Example aspects of the present disclosure are directed to improved skateboard trucks. One known configuration of a skateboard truck includes a metal alloy (e.g., aluminum) baseplate which mounts to the bottom surface of the skateboard using a multitude of steel machine screw fasteners and nylon insert locknuts. This known baseplate design can be square or oval in shape, with two major surfaces and can be made from aluminum metal, and can have a steel bolt pressed through a hole of the baseplate. The bolt can be oriented in such a fashion as to have the bolt head nested into a recess pocket on the major surface of the baseplate coincident to the bottom surface of the skateboard deck. The threaded portion of the bolt can be positioned protruding beyond the opposing major surface of the baseplate.

Conventional assembly of the hangar to the baseplate can include the following steps. Onto the exposed threaded shaft end of the kingpin is placed, a circular steel washer with a hole in its center. Next is placed a circular elastomeric bushing with a hole in the center. Next, the hanger's integral flange with circle receiver hole is fitted onto the kingpin. Next, a second circular elastomeric material bushing with a hole in its center is placed onto the kingpin. Next is a circular steel washer with a hole in its center. Finally, a common nylon insert hex locknut is threaded onto the kingpin end. The kingpin threads are of sufficient length as to allow for tightening of the nut. It is this nut tightening action which affixes the hanger to the baseplate. The tightening action itself and the degree to which the nut is tightened can affect the ease of which the hanger may turn relative to the baseplate and fixed kingpin. It is desirable for skateboard trucks to have this feature of tightening the nut and thus controlling the amount of tension on the hanger and ease or difficulty of turning which makes for increased control of the skateboard.

One potential problem with the design of some known trucks is that the end of the threaded kingpin is fixed, in particular, a fixed distance relative to the bottom surface of the skateboard and also relative to the ground upon which the skateboard rolls. Tightening the nut to increase turning tension on the hanger does not change the fixed position of the end of the kingpin. Conversely, loosening the nut to decrease turning tension on the hanger also does not change the fixed position of the end of the kingpin relative to the ground surface upon which the skateboard rolls. The end of the kingpin protrudes from the baseplate and hanger, and is exposed in such a way that obstacles on the ground surface can and often do impact the end of the kingpin. This impact can completely stop or alter the momentum of the skateboard, with the result that the user is at an increased risk of falling off the skateboard, losing control of the skateboard, or otherwise having motion of the skateboard be affected from desired motion.

It would be more desirable to have a skateboard truck design such that when the user wishes to tighten the kingpin nut to beneficially affect the tension of the turning of the truck hanger, the end of the kingpin would recede into the baseplate and create more dimensional clearance between it and any obstacles on the ground. It is desired to provide skateboard trucks having such capability.

As such, example aspects of the present disclosure are directed to a skateboard truck where the orientation of the kingpin and fastening and/or tightening nut are inverted or reversed (e.g., relative to conventional skateboards). The tightening nut can be permanently forced into a recess pocket on the major surface of the baseplate coincident to the bottom surface of the skateboard deck (e.g., as a step in the manufacturing, such as final assembly, of the truck). The assembly steps and/or orientations of the steel washers, elastomeric cushions, flange of the hanger, etc. can be the same as a known truck configuration, with the exception that the kingpin bolt head can be positioned to be protruding beyond the opposing major surface of the baseplate. The fastening/tightening nut can include a combination construction of a conventional nylon insert hex nut and an elongated hollow shaft, hereinafter referred to as a "monocoque shaft" or "monocoque shaft portion." The fastening/tightening nut can hereinafter be referred to as a "monocoque hex nut." The monocoque shaft portion of the monocoque hex nut can be forced into a hole in the baseplate using force from a hydraulic press. The material of the nut can be hardened steel and that of the kingpin bolt can also be hardened steel, but the material of the baseplate can be much softer aluminum.

According to example aspects of the present disclosure, the kingpin can be variably tightened into the baseplate of a skateboard truck, which is provided by the novel orientation of the kingpin according to example aspects of the present disclosure. As the user tightens the kingpin bolt head (e.g., which may be accomplished with a common tool such as a screwdriver, nut wrench, etc.), the bolt head recedes toward the baseplate. The result of this tightening action is that the clearance between any obstacle on the ground and the end surface of the kingpin bolt head increases. As the elastomeric cushions may wear, compress, or if the user desires to increase the tension and turning of the truck hanger further, more clearance can be created and the possibility of impacting obstacles also reduced, thus also reducing potential falls.

Simply inverting or reversing the orientation of the steel bolt kingpin and a common nylon insert locknut presents obvious problems in subsequent kingpin wear resulting from contact between the hardened steel kingpin and the aluminum baseplate, especially from induced movement over time. Thus, another example aspect of the present disclosure relates to an improved nut shaft design (e.g., the monocoque hex nut shaft) to prevent contact between the kingpin surface and the interior surface of the aluminum hole. The monocoque hex nut shaft provides for a fixed hard steel surface between the surface of the hole in the softer aluminum baseplate, and the much harder surface of the hardened steel king pin bolt. While the truck is in use and the hanger is turning, force is applied by tilting action of the halter, which is transmitted to the elastomeric bushings and ultimately to the exposed shaft of the kingpin. This force moves the kingpin slightly, dozens or hundreds of times per hour, and if the hardened steel kingpin were to directly contact the softer surface of the baseplate aluminum (e.g., as in some known skateboard trucks), wear (e.g., from force deformation) occurs on the circular hole of the baseplate. Over time, wear can change the shape of the hole from a circle to an oval. Because the shape of the hardened steel kingpin cross section is circular, but a worn baseplate hole can become ovalized, the kingpin cannot be firmly affixed to the baseplate. In use, the kingpin can move significantly from side to side, affecting the turning of the truck and skateboard, and in turn, creating the potential for the user to lose control of the skateboard and fall.

Nut shafts (e.g., monocoque shafts) designed according to example aspects of the present disclosure can prevent contact between the harder kingpin and the softer baseplate. This can provide for the inverted orientation of the kingpin according to example aspects of the present disclosure. For instance, the shaft portion of the monocoque hex design can be assembled into the baseplate by high pressure hydraulic force during manufacturing. Thus, aspects of the present disclosure provide for a controllable and adjustable ride in addition to having a design which recedes the kingpin end into the baseplate when tightening by the user, thus increasing safety. Skateboards according to example aspects of the present disclosure can additionally provide for improved durability and reduced likelihood of impact with road obstacles while the skateboard is in use.

In accordance with more particular aspects of the disclosed technology, an example skateboard truck can include both a kingpin and a threaded fastener, called a shaft nut, which when combined hold the two main components of a truck together to function properly. The two main components of a skateboard truck are the baseplate, which is mounted to the bottom surface of the skateboard deck; and the turning part of the truck called the hanger, which is mounted onto the baseplate by means of a metal bolt called a kingpin, and affixed tightly into the baseplate by means of a threaded shaft nut. Two rubber or elastomeric material bushings placed along the shaft of the kingpin and on either side of a flange protruding from the hanger hold the hanger in place by the tightening of the kingpin into the threaded shaft nut fastener.

According to an example aspect of the disclosed technology, the kingpin is configured in a specific orientation as it is mounted into the baseplate and held firm by the shaft nut which is permanently affixed into the baseplate. The specific orientation of the kingpin is inverse to other skateboard trucks known in the art. For instance, the orientation of the kingpin is such that a threaded portion of the kingpin (on an end opposite a bolt portion) is generally facing towards a bottom surface of the skateboard deck as opposed to away from the bottom surface of the skateboard deck.

According to another example aspect of the disclosed technology, the disclosed skateboard truck is configured in a manner whereby the levels of tightness of the skateboard truck can be adjusted and as the truck becomes tighter, the head of the kingpin bolt lowers closer to the baseplate. More clearance distance between the kingpin bolt head and the ground is advantageous for the skateboard user so as to lessen the possibility of impacting any obstacle which one might roll over when using the skateboard. Impacting an obstacle will result in the user falling off the skateboard. The shaft nut embedded into the baseplate has an elongated steel sleeve which protrudes in the direction toward the kingpin bolt head. This unique monocoque design of nut and sleeve holds the kingpin shaft firmly into the drilled retaining hole in the baseplate, and prevents movement or vibration during the use of the skateboard.

The skateboard truck technology described herein can help improve the integrity of overall skateboard structure, the efficacy of skateboard operation, and the safety of skateboard operators. By providing a skateboard truck configuration that allows for greater clearance distance between a kingpin component and the ground, a possibility of impact between the skateboard and obstacles in a travel path is reduced. This impact reduction means that skateboards can operate for longer durations between impact and/or that potential impact occurs with less severity. Both of these impact reduction scenarios can beneficially preserve the structure of the skateboard and its overall ability to continue in functional and effective operation. Additionally, the disclosed skateboard truck technology advantageously provides beneficial performance and safety measures to a skateboard operator. Impact reduction due to increased ground clearance can help to reduce the likelihood that a skateboard user will fall off the skateboard or potentially experience injury due to impact of the skateboard with an obstacle striking the kingpin.

Reference now will be made in detail to embodiments, one or more example(s) of which are illustrated in the drawings. Each example is provided by way of explanation of the embodiments, not limitation of the present disclosure fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

With reference now to the Figs., example implementations of the present disclosure will be discussed in further detail.

Figure 1C:
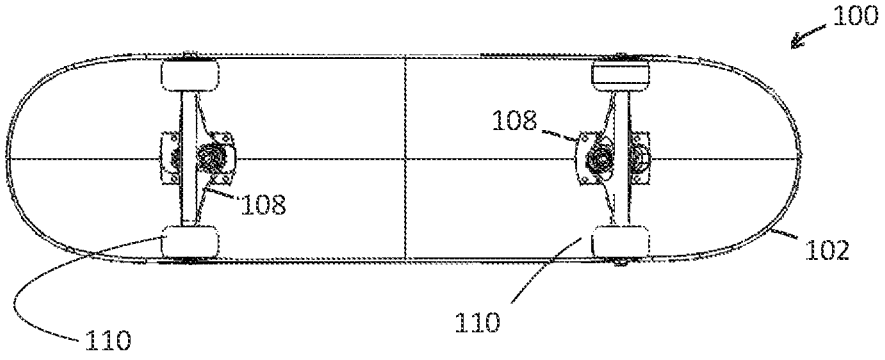
FIG. 1C provides a bottom plan view of a skateboard according to example embodiments of the present disclosure.
Figure 1D:
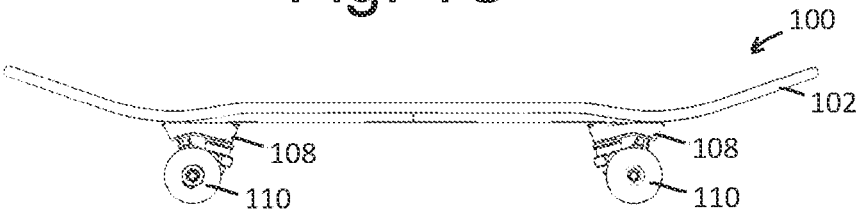
FIG. 1D provides a side plan view of a skateboard according to example embodiments of the present disclosure.

FIGS. 1A-1D collectively provide four profile views of a skateboard according to example embodiments of the present disclosure. More particularly. FIG. 1A provides a top perspective view of an example conventional skateboard 100, while FIG. 113 provides a bottom perspective view of skateboard 100, FIG. 1C provides a bottom plan view of skateboard 100, and FIG. 1D provides a side plan view of skateboard 100. Skateboard 100 includes a skateboard deck 102 formed as an elongated platform that has two opposing surfaces, namely a top surface 104 and a bottom surface 106. The top surface 104 of skateboard deck 102 corresponds to a surface upon which a skateboard user stands. The bottom surface 106 of skateboard deck 102 corresponds to a surface upon which two skateboard trucks 108 are mounted using, for example, machine screws or bolts. Wheels 110 and assembled bearings inside the wheels can be mounted to the truck axles. In one example, each skateboard truck 108 can have two wheels 110 and four bearings.

Figure 2:
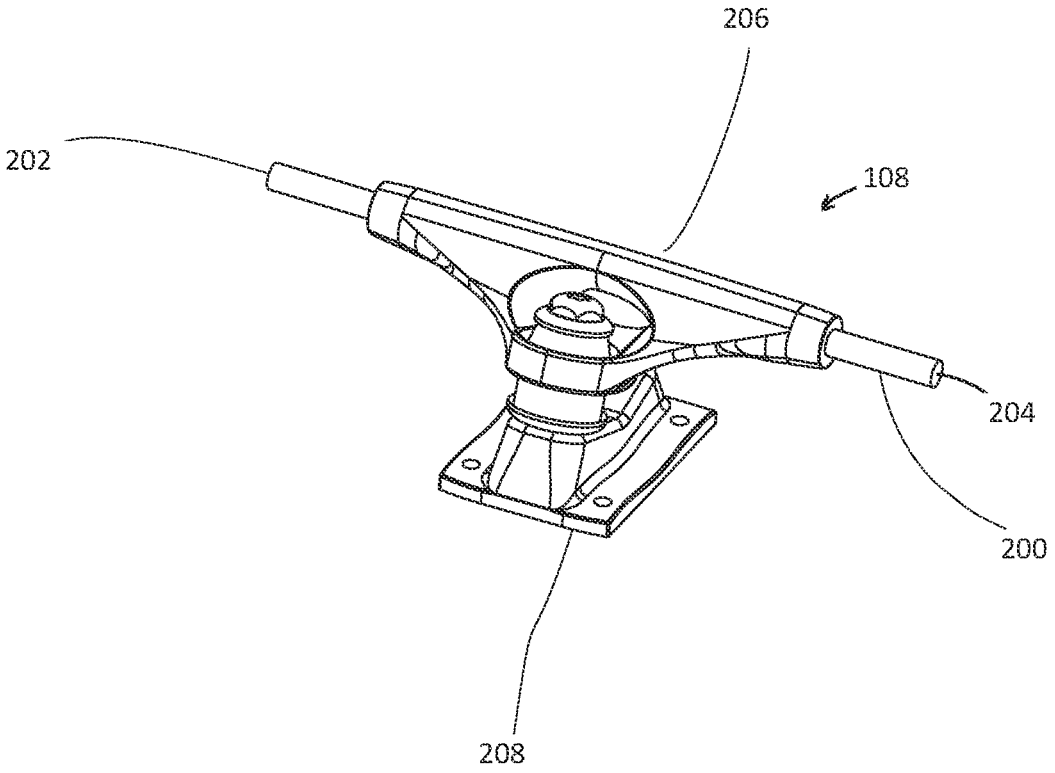
FIG. 2 provides an isometric view of a completely assembled skateboard truck according to example aspects of the present disclosure.

FIG. 2 provides an isometric view of a completely assembled skateboard truck 108 according to example aspects of the present disclosure. More particularly, the skateboard truck 108 of FIG. 2 includes an axle 200, a hanger 206, and a baseplate 208. Axle 200 can be characterized by a first end 202 and second end 204 opposing the axle first end 202. Hanger 206 can be configured to hold axle 200, for example, in a manner such that a major axis of the axle 200 is coincident to a major axis of the hanger 206. FIG. 2 depicts an orientation of the axle 200 inside the hanger 206. The axle 200 can include two axle ends, namely first end 202 and second end 204, each axle end configured to extend beyond surfaces of the hanger 206. The first end 202 and second end 204 of axle 200 can also have threads cut into each axle end such that they are configured for bearings and wheels (e.g., wheels 110) to be affixed thereto. In some embodiments, the axle 200 can be formed of steel or other suitable material. The baseplate 208 can be configured for mounting to a bottom surface of a skateboard deck (e.g., bottom surface 106 of skateboard deck 102).

Figure 3:
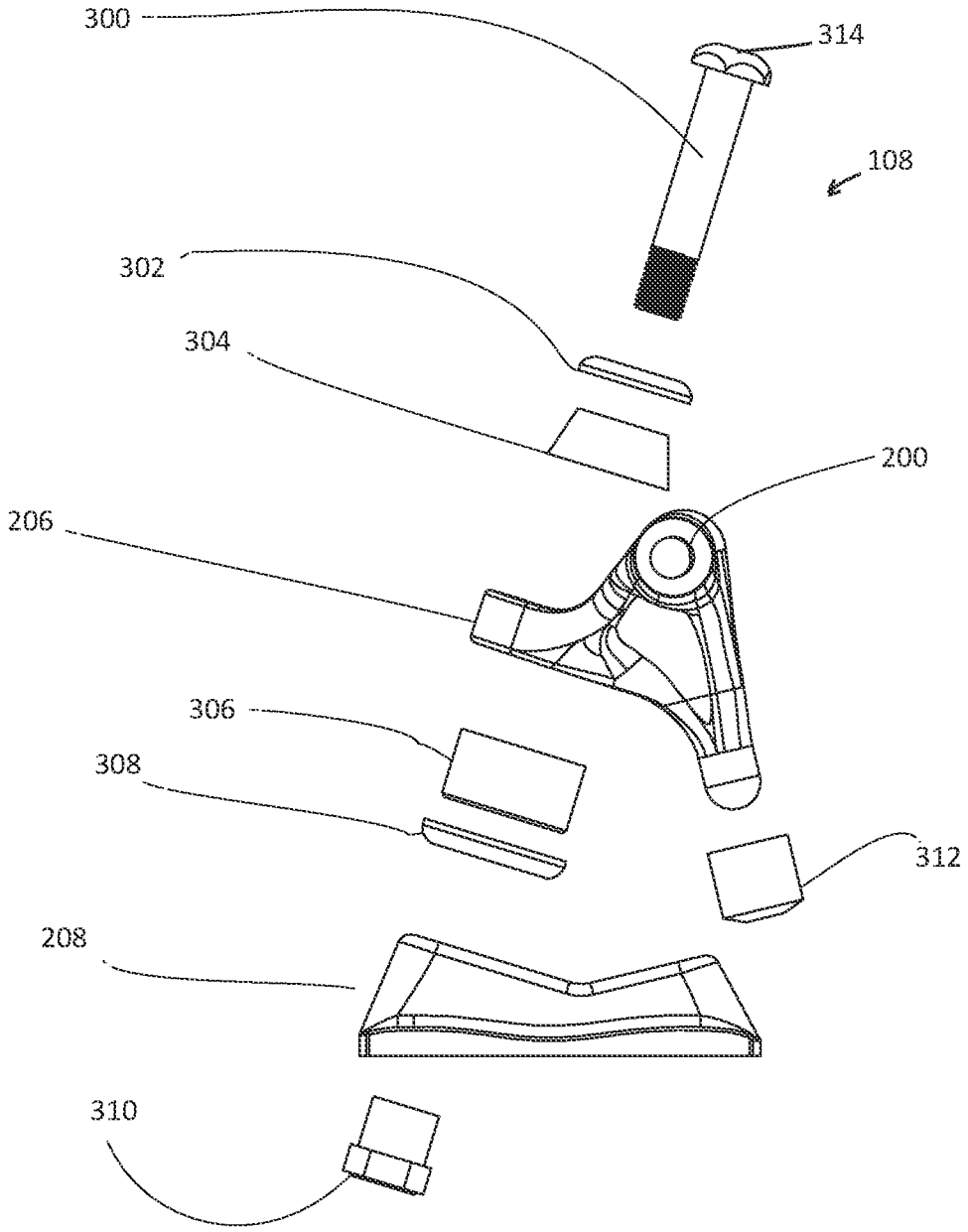
FIG. 3 provides an exploded side view of a skateboard truck according to example aspects of the present disclosure.
Figure 4:
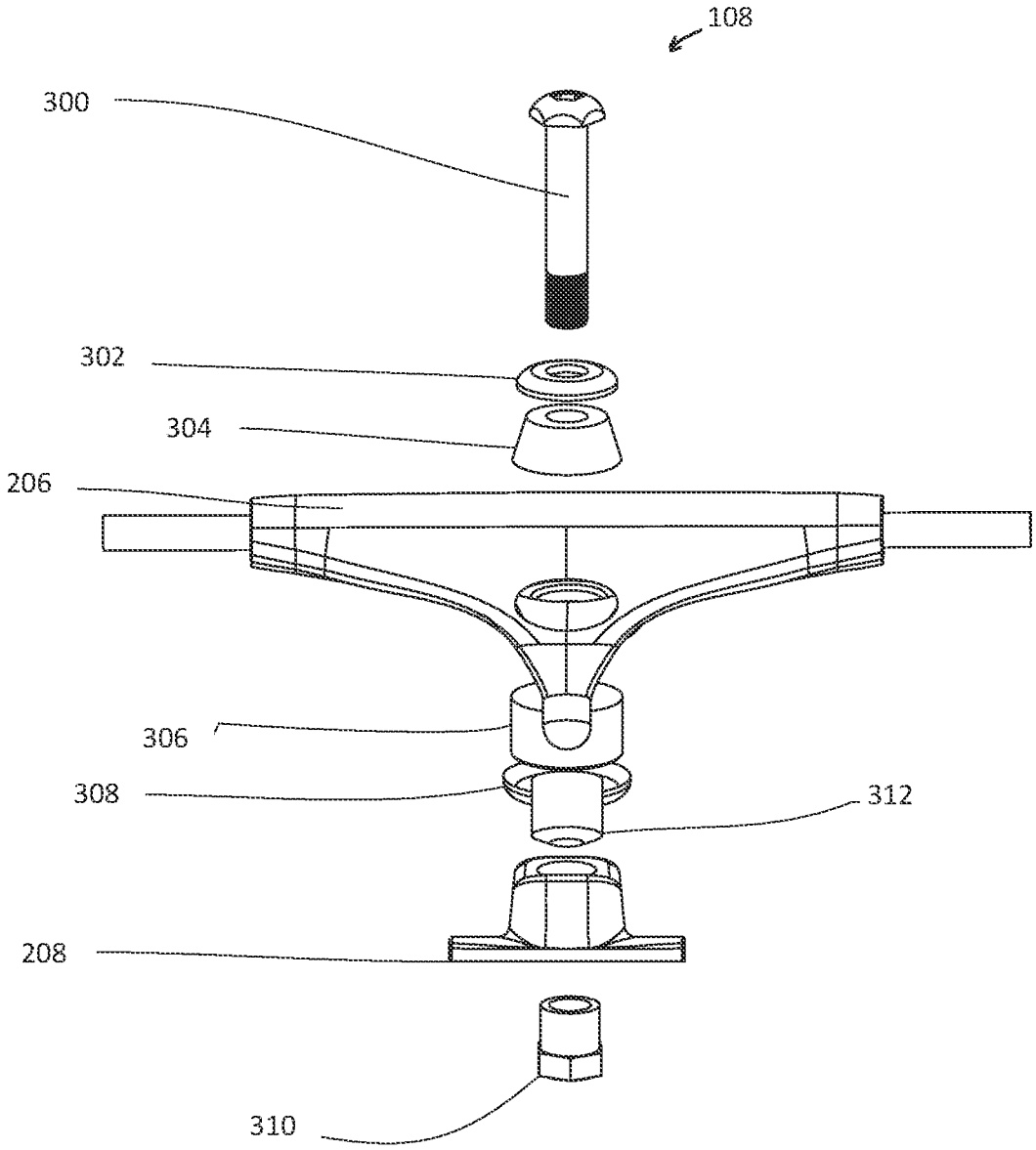
FIG. 4 provides an exploded front view of a skateboard truck according to according to example aspects of the present disclosure.

FIGS. 3 and 4 provide respective exploded views of a skateboard truck 108 according to example aspects of the present disclosure. FIG. 3 provides an exploded side view of skateboard truck 108, while FIG. 4 provides an exploded front view. More particularly, skateboard truck 108 can include a kingpin bolt 300, a first washer 302, a first bushing 304, hanger 206, a second bushing 306, a second washer 308, baseplate 208, a monocoque hex nut 310, and a pivot cup 312. Skateboard truck 108 notably can include the inverted kingpin bolt 300 with bolt head 314 outside of the baseplate 208 and the monocoque hex nut 310 below the baseplate 208. The suspension components of the skateboard truck 108 include the first washer 302, the first bushing 304, the hanger 206, the second bushing 306, the second washer 308, and the baseplate 208. The hanger 206 can include a mounting flange with a through hole at the center of the flange. The hanger 206 can have a special pivot point in the design, which can be surrounded by, a pivot cup 312. The first bushing 304 and second bushing 306 can be placed along the shaft of the kingpin bolt 300 and on either side of the mounting flange protruding from the hanger 206 to hold the hanger 206 in place relative to baseplate 208 by the tightening of the kingpin bolt 300 into a threaded shaft nut fastener embodied by monocoque hex nut 310. In some example embodiments, the first washer 302 and/or the second washer 308 can be made of steel or other suitable material. In some example embodiments, the first bushing 304 and/or second bushing 306 can be made of rubber or an elastomeric material, such as but not limited to an elastomer plastic, or other suitable material. In some example embodiments, pivot cup 312 can be made of an elastomeric material, such as but not limited to elastomer plastic, or other suitable material.

Figure 5:
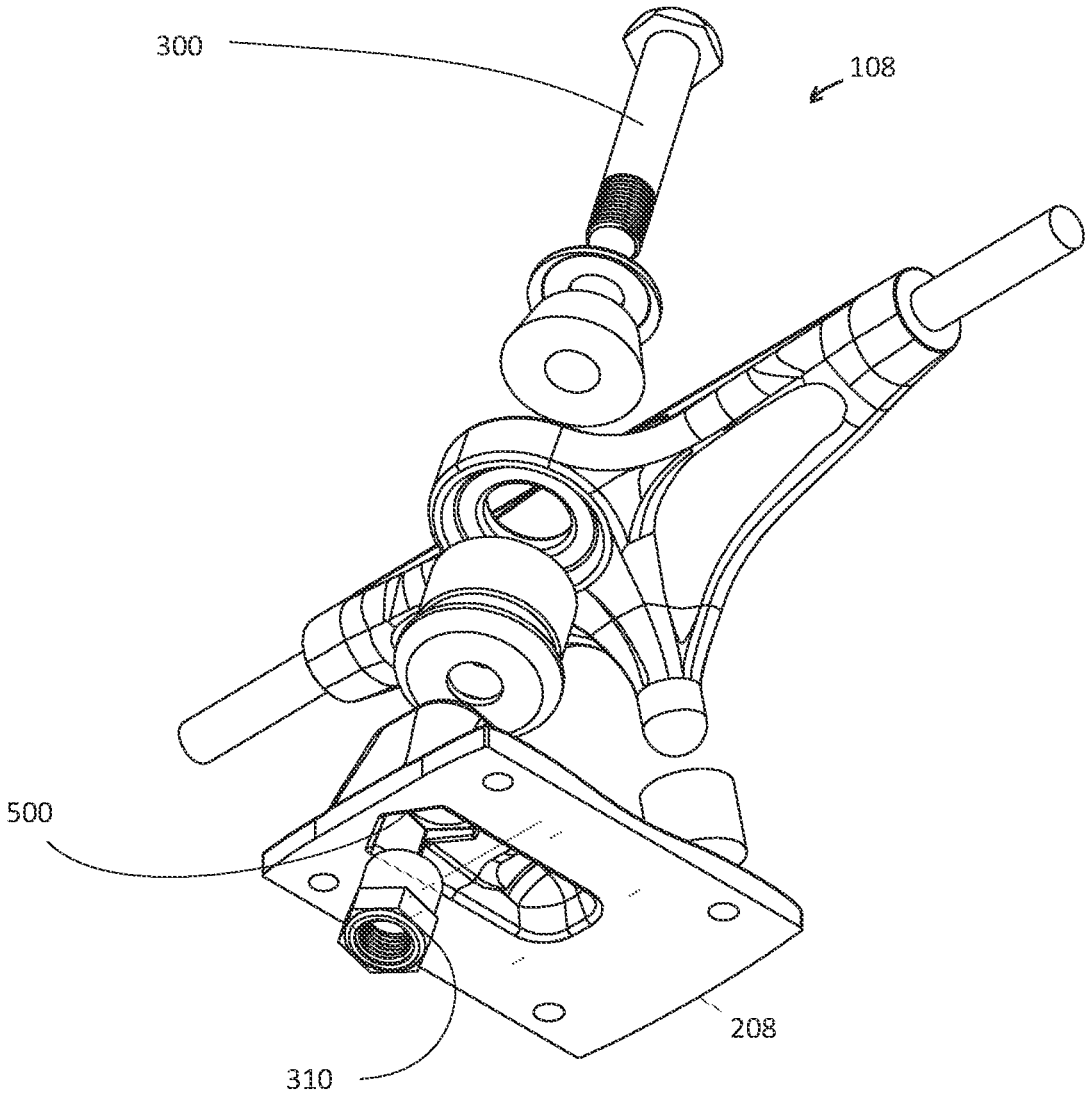
FIG. 5 provides an exploded view of a skateboard truck baseplate according to example aspects of the present disclosure.

FIG. 5 provides another exploded view of skateboard truck 108, particularly depicting example aspects of baseplate 208. FIG. 5 also depicts kingpin bolt 300 and its orientation to the monocoque hex nut 310, both on either side of the truck baseplate 208. In some examples, baseplate 208 can be made of aluminum or other suitable material. Additional aspects of baseplate 208 are depicted, for example, in FIGS. 10A-10C and FIGS. 11A-11B.

Figure 6A:
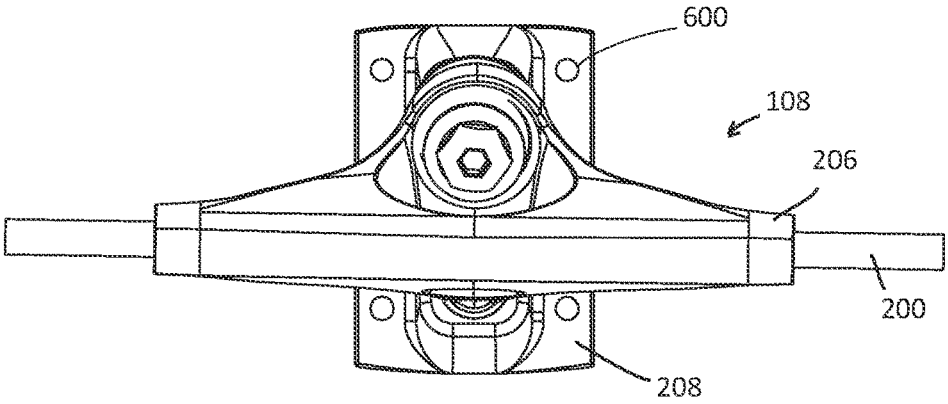
FIG. 6A provides a top view of an assembled skateboard truck according to example aspects of the present disclosure.
Figure 6B:
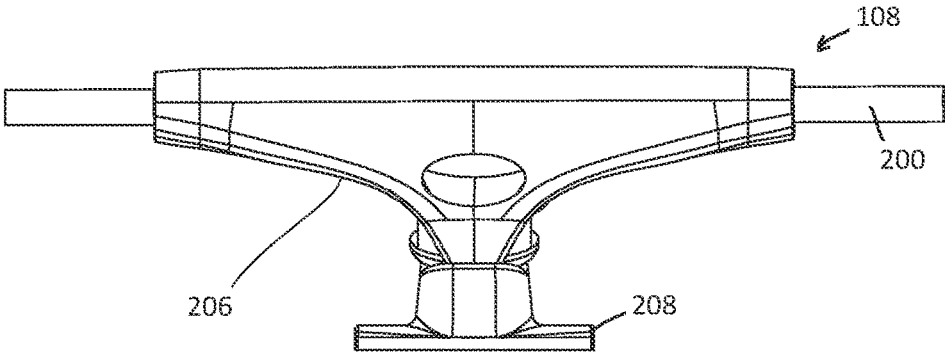
FIG. 6B provides a front view of an assembled skateboard truck according to example aspects of the present disclosure.
Figure 6C:
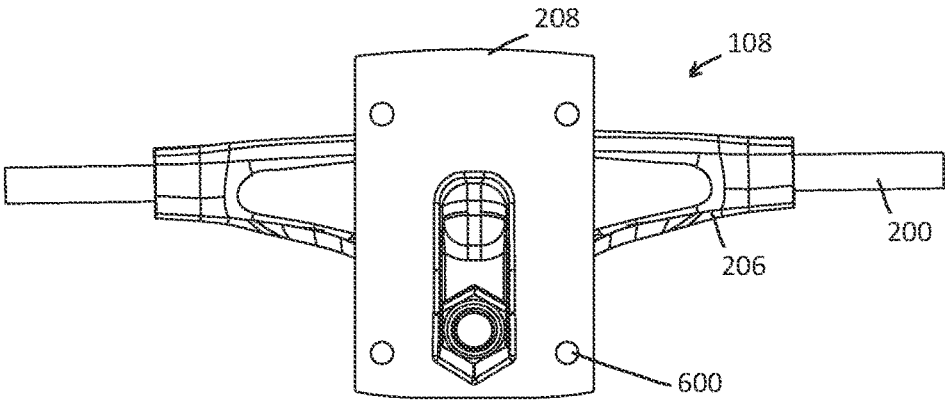
FIG. 6C provides a bottom view of an assembled skateboard truck according to example aspects of the present disclosure.

FIGS. 6A-6C provide respective assembled views of a skateboard truck 108 according to example aspects of the present disclosure. FIG. 6A provides a top view of assembled skateboard truck 108, FIG. 6B provides a front view of assembled skateboard truck 108, and FIG. 6C provides a bottom view of assembled skateboard truck 108. Skateboard truck 108 includes hanger 206 and baseplate 208. Hanger 206 is configured to hold axle 200 as illustrated. Baseplate 208 can include a plurality of mounting through holes 600. In some examples, as illustrated in FIGS. 6A-6C, baseplate 208 is generally rectangular in shape and includes four mounting through holes 600, one in each corner of the generally rectangular baseplate 208. It should be appreciated that the baseplate 208 could also be formed in different shapes, such as but not limited to a square shape, a circular shape, or an oval shape. In addition, the number and placement of the mounting through holes 600 can vary in accordance with different skateboard truck embodiments. For example, a baseplate 208 can include two, three, four, five, six, seven, eight or other number of mourning through holes 600. A skateboard truck 108 can be mounted to a skateboard deck (e.g., skateboard deck 102 as illustrated in FIGS. 1A-1D) by way of machine screws or bolts and nuts secured at the mounting through holes 600.

Figure 7A:
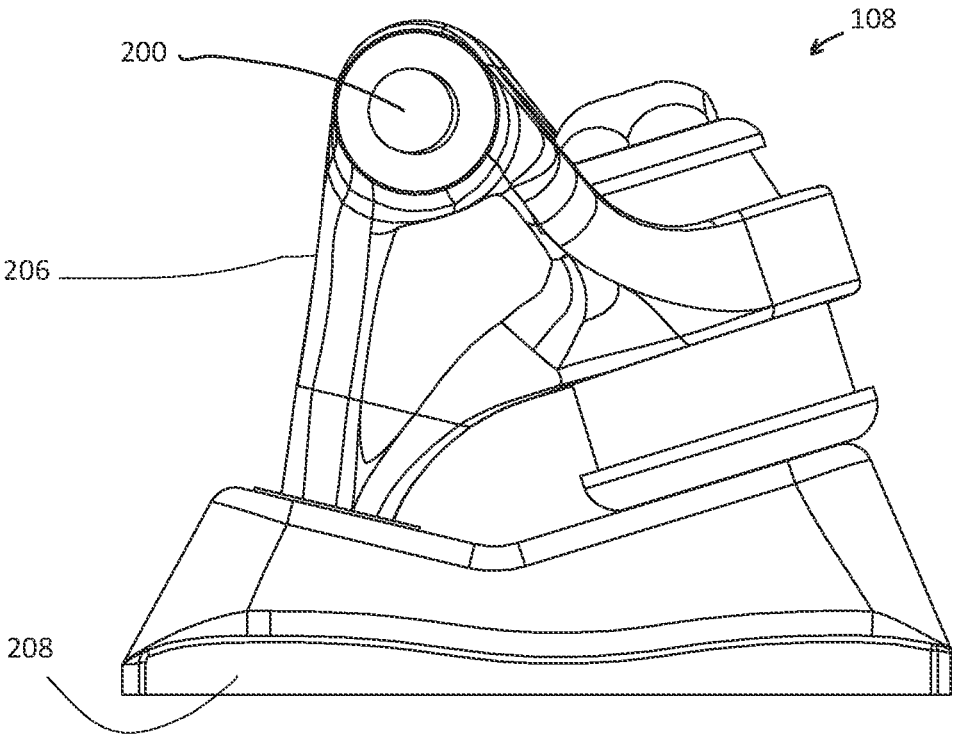
FIG. 7A provides a side full view of an assembled skateboard truck according to example aspects of the present disclosure.
Figure 7B:
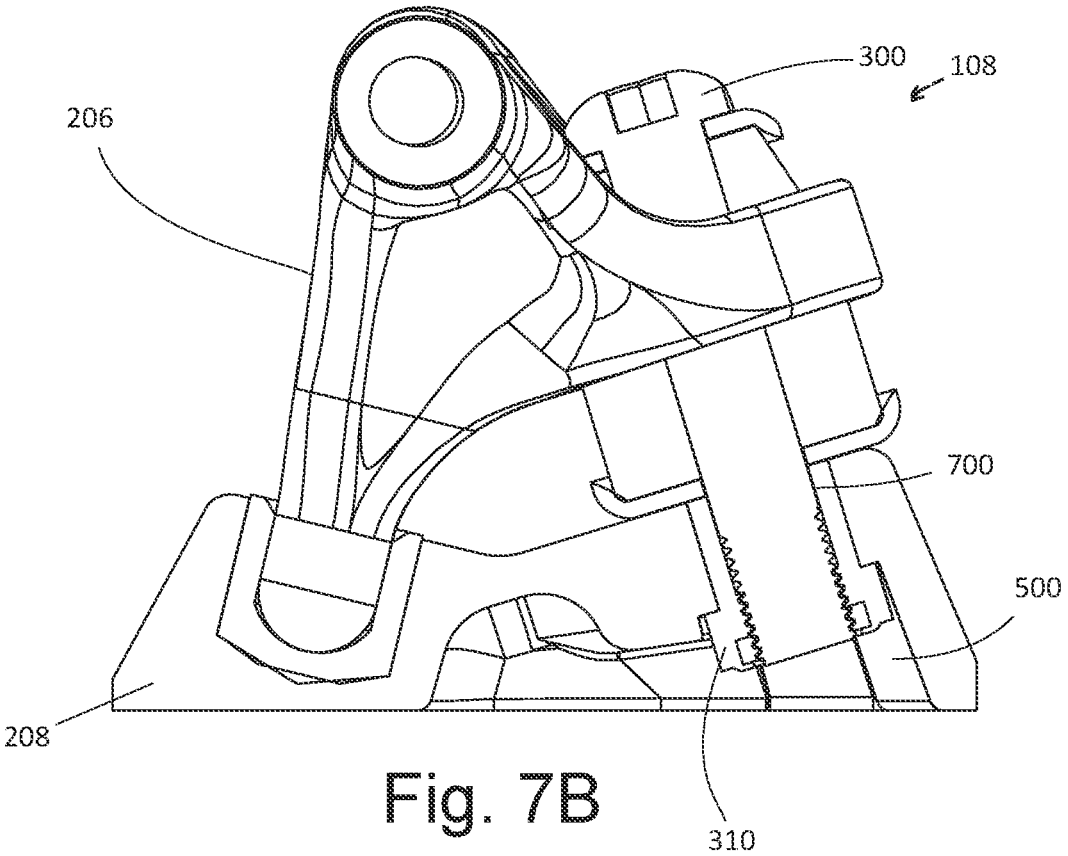
FIG. 7B provides a side cross-sectional view of an assembled skateboard truck according to example aspects of the present disclosure.

FIGS. 7A-7B depict respective side views of an assembled skateboard truck 108 according to example aspects of the present disclosure. FIG. 7A provides a side full view of skateboard truck 108, while FIG. 7B provides a side cross-sectional view of skateboard truck 108. FIG. 7A depicts hanger 206 with axle 200 assembled relative to baseplate 208 via kingpin bolt 300 and hex nut 310. As better illustrated in the cross-sectional view of FIG. 713, the monocoque hex nut 310 is positioned with its shaft portion fitted into the recess 500 of the baseplate 208. Monocoque hex nut 310 is formed to define a center hole 700 throughout, with threads, where the kingpin bolt 300 can slide though and engage the threads. Kingpin bolt 300 can be configured to be variably tightened into baseplate 208. The more kingpin bolt 300 is tightened, the more clearance is provided between skateboard truck 108 and a ground surface. The kingpin bolt 300 is configured for orientation relative to a skateboard deck such that a first end (corresponding to a threaded portion) generally faces the bottom surface of a skateboard deck (e.g., bottom surface 106 of skateboard deck 102).

Figure 8A:
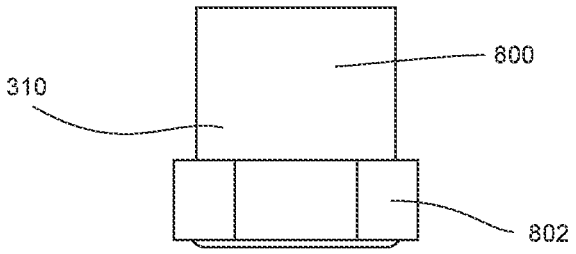
FIG. 8A provides a side full view of a monocoque hex nut according to example aspects of the present disclosure.
Figure 8B:
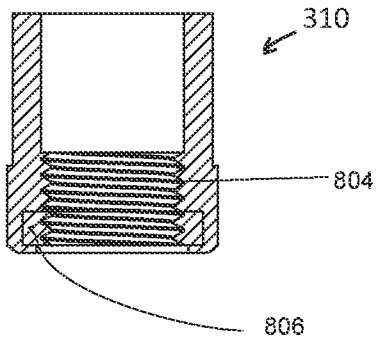
FIG. 8B provides a side cross-sectional view of a monocoque hex nut according to example aspects of the present disclosure.
Figure 8C:
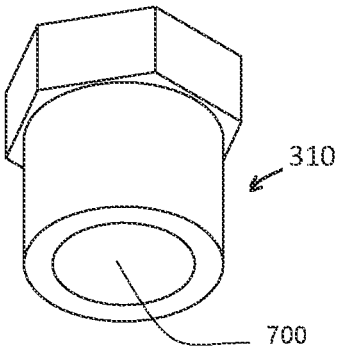
FIG. 8C provides a bottom perspective view of a monocoque hex nut according to example aspects of the present disclosure.
Figure 8D:
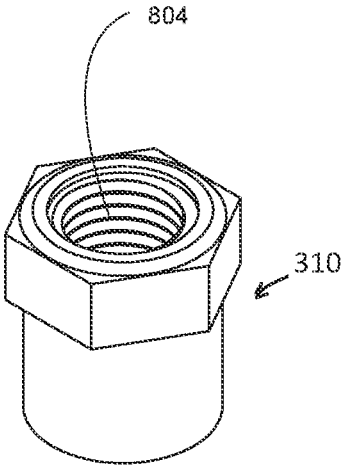
FIG. 8D provides a top perspective view of a monocoque hex nut according to example aspects of the present disclosure.

FIGS. 8A-8D provide respective views of a monocoque hex nut 310 according to example aspects of the present disclosure. FIG. 8A depicts a side full view of monocoque hex nut 310, FIG. 8B depicts a side cross-sectional view of monocoque hex nut 310, FIG. 8C depicts a bottom perspective view of monocoque hex nut 310, and FIG. 8D depicts a top perspective view of monocoque hex nut 310. Monocoque hex nut 310 can include a shaft portion 800 and a hex portion 802. Hex portion 802 can be formed adjacent to shaft portion 800. Monocoque hex nut 310 can be formed to define a center hole 700 throughout. An inside surface of center hole 700 formed throughout the hex portion 802 and the shaft portion 800 can include cut threads 804. Cut threads 804 of monocoque hex nut 310 are intended to engage with a threaded portion of kingpin bolt 300. Hex portion 802 of monocoque hex nut 310 can be formed as a generally hexagonal shaped nut, although it should be appreciated that other polygonal variations are also within the scope of the disclosed technology. Shaft portion 800 of monocoque hex nut 310 can be formed with a smooth circular outer diameter surface with no threads. Monocoque hex nut 310 can also include a special nylon insert ring 806 that helps facilitate engagement of kingpin bolt 300 with monocoque hex nut 310.

Figure 9A:
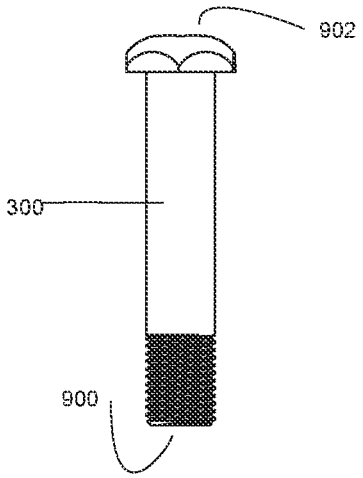
FIG. 9A provides a side full view of a kingpin bolt according to example aspects of the present disclosure.
Figure 9B:
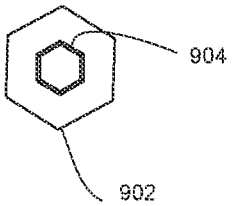
FIG. 9B provides a top view of a kingpin bolt according to example aspects of the present disclosure.
Figure 9C:
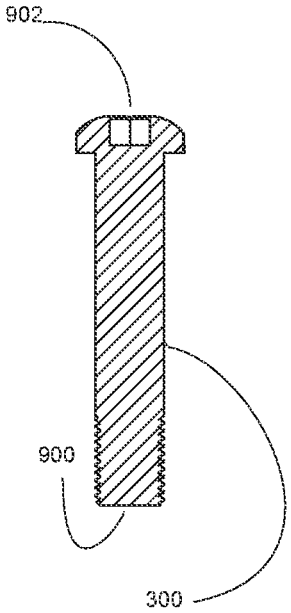
FIG. 9C provides a side cross-sectional view of a kingpin bolt according to example aspects of the present disclosure.

FIGS. 9A-9C provide respective views of a kingpin bolt 300 according to example aspects of the present disclosure. FIG. 9A depicts a side full view of kingpin bolt 300, FIG. 9B depicts a top view of kingpin bolt 300, and FIG. 9C depicts a side cross-sectional view of kingpin bolt 300. Kingpin bolt 300 can include first and second opposing ends, with the first end of the kingpin bolt 300 corresponding to a threaded portion 900 and a second end of the kingpin bolt 300 corresponding to a bolt head portion 902. The threaded portion 900 of kingpin bolt 300 can engage and help affix the kingpin bolt 300 to a monocoque hex nut (e.g., monocoque hex nut 310) to secure a baseplate (e.g., baseplate 208) and hanger (e.g., hanger 206) together relative to a bottom surface of a skateboard deck (e.g., bottom surface 106 of skateboard deck 102). In some examples, the bolt head portion 902 can be configured in a polygonal shape, such as but not limited to a round shape or a hex shape. The kingpin bolt 300 can be turned with tools from the outside surface of the bolt head portion 902 (e.g., the hex shape), such as shown in the top view of FIG. 9B. Additionally or alternatively, a hex wrench may also turn the kingpin bolt 300 by placing the hex wrench into the hex hole 904 in the top of the bolt head portion 902.

Figure 10A:
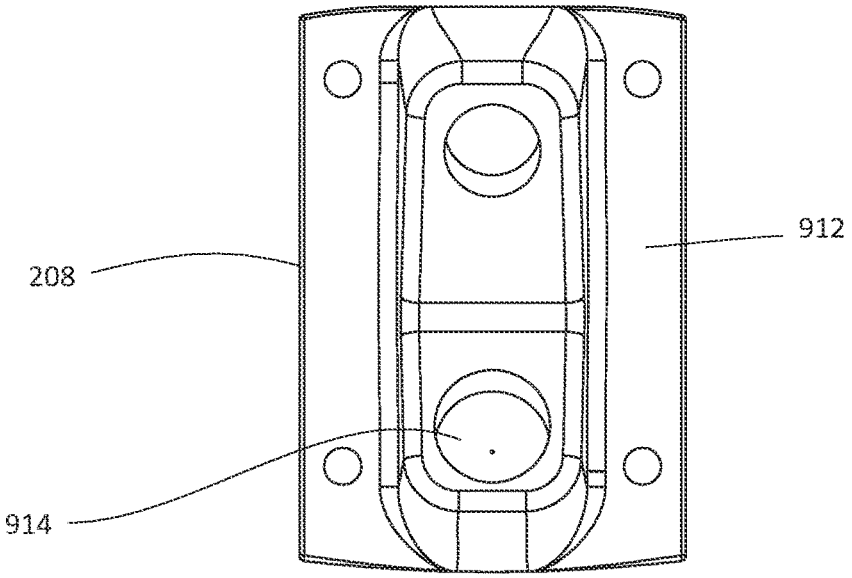
FIG. 10A provides a top view of a baseplate according to example aspects of the present disclosure.
Figure 10B:
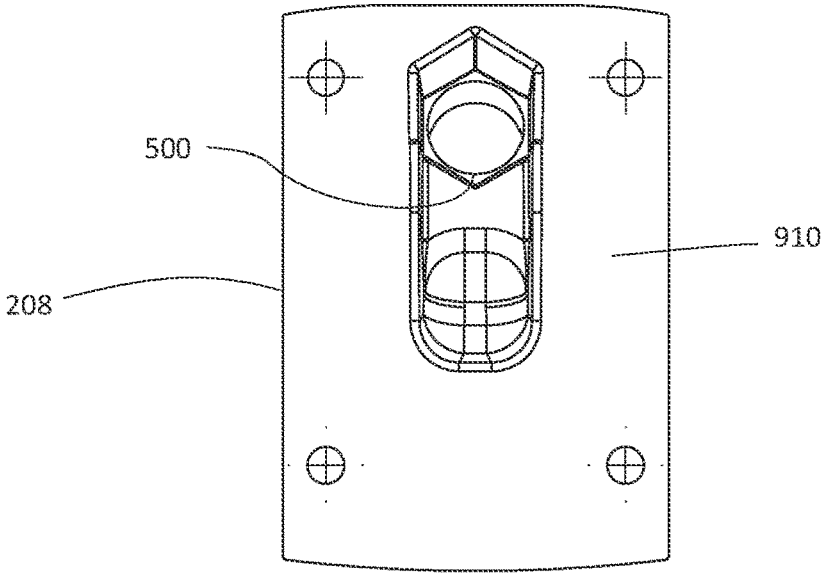
FIG. 10B provides a bottom view of a baseplate according to example aspects of the present disclosure.
Figure 10C:
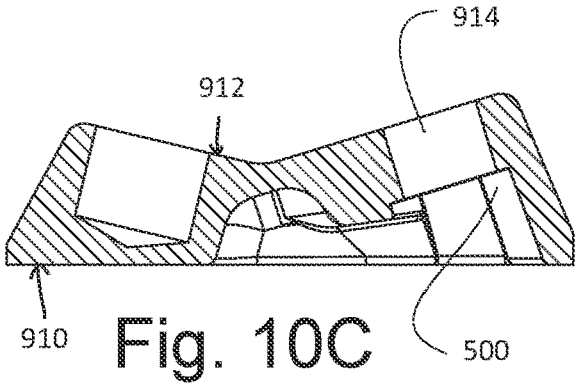
FIG. 10C provides a side cross-sectional view of a baseplate according to example aspects of the present disclosure.

FIGS. 10A-10C provide respective views of an example baseplate 208 according to example aspects of the present disclosure. FIG. 10A depicts a top view of baseplate 208, while FIG. 10B depicts a bottom view of a baseplate 208, and FIG. 10C depicts a side cross-sectional view of baseplate 208. Baseplate 208 can include first and second opposing primary surfaces, such as first primary surface 910 and second primary surface 912. The first primary surface 910 of baseplate 208 is configured to be positioned coincident with a bottom surface of a skateboard deck (e.g., bottom surface 106 of skateboard deck 102). The first primary surface 910 of baseplate 208 can include recess 500, corresponding to a recessed cavity to fit a monocoque hex nut (e.g., hex portion 802 of monocoque hex nut 310). The baseplate 208 can also include a through hole 914 that is bored through the recess 500 and out to the second primary surface 912 of baseplate 208. Through hole 914 can be configured to house the outer radial surface of the shaft portion of a monocoque hex nut (e.g., shaft portion 800 of monocoque hex nut 310). More particularly, through hole 914 can have the same inside dimension as an outer major surface of the monocoque hex nut with shaft.

Figure 11A:
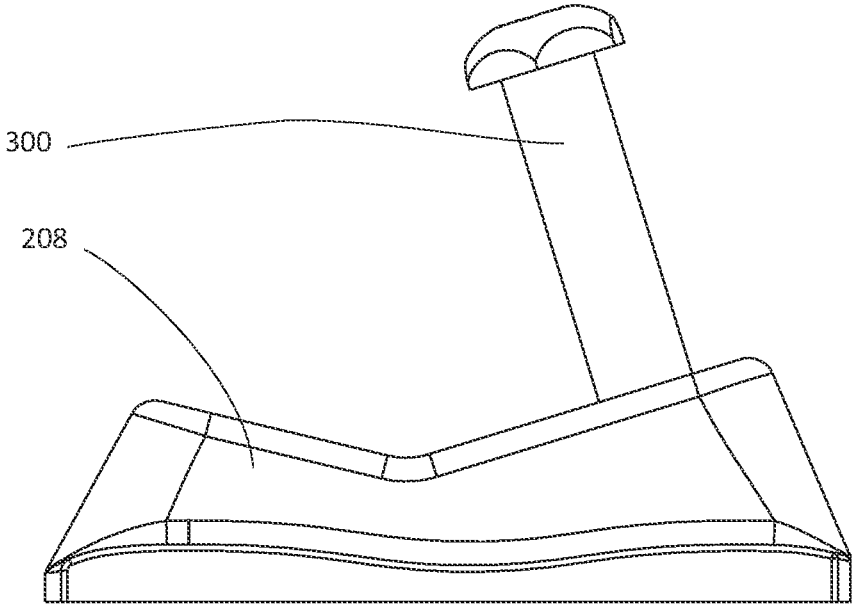
FIG. 11A provides a side full view of a baseplate with kingpin bolt and monocoque hex nut installed according to example aspects of the present disclosure.
Figure 11B:
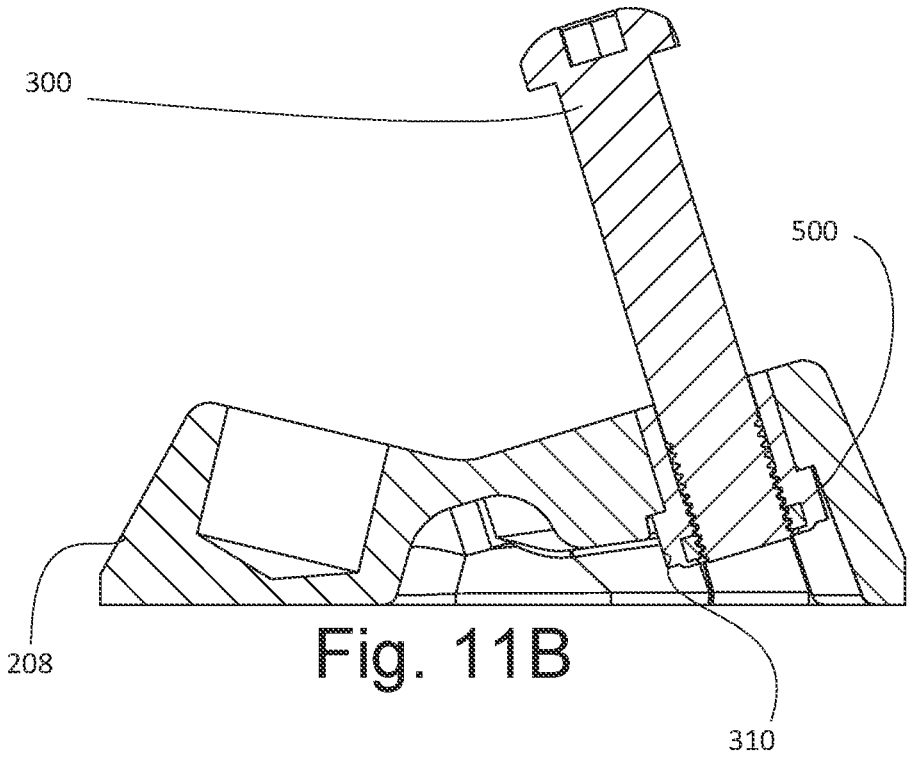
FIG. 11B provides a side cross-sectional view of a baseplate with kingpin bolt and monocoque hex nut installed according to example aspects of the present disclosure.

FIGS. 11A-11B provide respective views of an example baseplate 208 with kingpin bolt 300 and monocoque hex nut 310 installed according to example aspects of the present disclosure. FIG. 11A depicts a side full view of such assembly, while FIG. 11B depicts a side cross-sectional view of such assembly. In particular, FIG. 11A shows an orientation of the kingpin bolt 300 to the baseplate 208, while FIG. 11B shows the kingpin bolt 300 engaging the threads of a monocoque hex nut 310. The hex portion (e.g., hex portion 802) of the monocoque hex nut 310 is nesting in the baseplate recess 500.

While the present subject matter has been described in detail with respect to various specific example embodiments thereof, each example is provided by way of explanation, not limitation of the disclosure. Those skilled in the art, upon attaining an understanding of the foregoing, can readily produce alterations to, variations of, and/or equivalents to such embodiments. Accordingly, the subject disclosure does not preclude inclusion of such modifications, variations, and/or additions to the present subject matter as would be readily apparent to one of ordinary skill in the art. For instance, features illustrated and/or described as part of one embodiment can be used with another embodiment to yield a still further embodiment. Thus, it is intended that the present disclosure cover such alterations, variations, and/or equivalents.

What is claimed is:

1. A skateboard truck, comprising:

a baseplate configured for mounting to a bottom surface of a skateboard deck, wherein the baseplate comprises: (i) a recessed cavity formed relative to a first primary surface of the baseplate; and (ii) a through hole formed adjacent to the recessed cavity relative to a second primary surface of the baseplate;

a hanger configured to hold an axle;

a fastening nut mounted inside the baseplate, wherein the fastening nut comprises: (i) a first portion configured to be fitted within the recessed cavity of the baseplate; and (ii) a second portion adjacent to the first portion, the second portion configured to be fitted within the through hole of the baseplate; and a kingpin bolt having a threaded portion affixed to the fastening nut to secure the baseplate and hanger together relative to the bottom surface of the skateboard deck.

2. The skateboard truck of claim 1, wherein the kingpin bolt is configured to be tightened into the baseplate.

3. The skateboard truck of claim 1, wherein a first end of the kingpin bolt comprises the threaded portion, and wherein a second end of the kingpin bolt comprises a bolt head configured in one of a hex shape or a round shape.

4. The skateboard truck of claim 3, wherein the kingpin bolt is oriented such that the first end of the kingpin bolt generally faces the bottom surface of the skateboard deck.

5. The skateboard truck of claim 1, wherein:

the fastening nut comprises a monocoque hex nut;

the first portion of the fastening nut comprises a hex portion; and the second portion of the fastening nut comprises a shaft portion.

6. The skateboard truck of claim 5, wherein the hex portion and the shaft portion are formed to define a center hole throughout.

7. The skateboard truck of claim 6, wherein:

an inside surface of the center hole formed throughout the hex portion and the shaft portion comprises cut threads; and an outer surface of the monocoque hex nut has a smooth circular diameter with no threads.

8. The skateboard truck of claim 1, wherein the baseplate comprises aluminum.

9. The skateboard truck of claim 1, wherein the baseplate is formed in a shape of one of a rectangle, oval, or square.

10. The skateboard truck of claim 1, wherein the first primary surface of the baseplate is configured to be positioned coincident with the bottom surface of the skateboard deck.

11. The skateboard truck of claim 10, wherein the first primary surface of the baseplate comprises the recessed cavity to fit the first portion of the fastening nut.

12. The skateboard truck of claim 11, wherein the baseplate comprises the through hole that is bored through the recess cavity and out to the second primary surface.

13. The skateboard truck of claim 12, wherein the baseplate through hole has a same inside dimension as an outer major surface of the fastening nut.

14. The skateboard truck of claim 1, wherein the hanger comprises an aluminum hanger configured to hold a steel axle.

15. The skateboard truck of claim 14, wherein the hanger comprises a mounting flange with a through hole at a center of the mounting flange.

16. The skateboard truck of claim 14, wherein a major axis of the axle is coincident to a major axis of the hanger.

17. The skateboard truck of claim 14, wherein the axle comprises two axle ends with threads cut into each axle end.

18. The skateboard truck of claim 17, wherein each axle end is configured to extend beyond an outer surface of the hanger.

19. The skateboard truck of claim 17, wherein bearings and wheels are affixed to each axle end.

20. The skateboard truck of claim 14, wherein an axis of the axle is coaxial with an axis of the hanger.

* * * * *